US006330872B1

(12) United States Patent
Leonard et al.

(10) Patent No.: US 6,330,872 B1
(45) Date of Patent: Dec. 18, 2001

(54) CYLINDER HEAD CASTING WITH GUSSET RIBS

(75) Inventors: Jay F. Leonard; John S. Foy, both of Columbus, IN (US)

(73) Assignee: Cummins Engine Company, Inc., Columbus, IN (US)

( * ) Notice: Subject to any disclaimer, the term of this patent is extended or adjusted under 35 U.S.C. 154(b) by 0 days.

(21) Appl. No.: 09/639,669

(22) Filed: Aug. 16, 2000

(51) Int. Cl.[7] ..... F02F 1/30
(52) U.S. Cl. ..... 123/193.5; 123/41.82
(58) Field of Search ..... 123/193.5, 41.82 R, 123/41.31

(56) References Cited

U.S. PATENT DOCUMENTS

| | | | | |
|---|---|---|---|---|
| 3,769,948 | * | 11/1973 | Feichtinger et al. | 123/41.31 |
| 3,830,209 | | 8/1974 | Jones, Jr. et al. . | |
| 4,106,444 | * | 8/1978 | Deutschmann et al. | 123/41.82 R |
| 4,131,093 | | 12/1978 | Mansfield . | |
| 4,554,892 | | 11/1985 | Amemori et al. . | |
| 4,616,600 | | 10/1986 | Hirano . | |
| 4,658,763 | * | 4/1987 | Gobien et al. | 123/193.5 |
| 4,774,912 | | 10/1988 | Nakano et al. . | |
| 4,844,030 | | 7/1989 | McAvoy . | |
| 4,944,263 | | 7/1990 | Nagano et al. . | |
| 4,957,068 | * | 9/1990 | Wagner et al. | 123/41.82 R |
| 5,080,057 | * | 1/1992 | Batzill et al. | 123/193.5 |
| 5,743,218 | * | 4/1998 | Aupperle et al. | 123/193.5 |
| 5,809,968 | | 9/1998 | Tsuchida . | |
| 5,964,196 | * | 10/1999 | Sigle et al. | 123/193.5 |
| 6,024,057 | | 2/2000 | Betchaku . | |

* cited by examiner

*Primary Examiner*—Marguerite McMahon
(74) *Attorney, Agent, or Firm*—Woodard, Emhardt, Naughton, Moriarty & McNett

(57) ABSTRACT

A unitary cylinder head casting for an engine includes a plurality of valve guide bore casting portions, each valve guide bore casting portion defining a valve guide bore and a plurality of head bolt bore casting portions, each head bolt bore casting portion defining a head bolt bore. The cylinder head casting is constructed and arranged such that there is at least one head bolt bore corresponding to each valve guide bore. The cylinder head casting also defines an upper water jacket and a lower water jacket. In order to eliminate fillets in the area of the upper water jacket which represent likely locations for fatigue cracks to initiate, gusset ribs are included as part of the cylinder head casting. There is at least one gusset rib extending between at least one combination of one head bolt bore casting portion and its corresponding valve guide bore casting portion.

16 Claims, 5 Drawing Sheets

CYLINDER HEAD CASTING WITH GUSSET RIBS

BACKGROUND OF THE INVENTION

The present invention relates in general to the design and construction of cylinder heads for internal combustion engines. More specifically the present invention relates to modifications to the internal construction of a cylinder head and cylinder head casting in order to add stiffening and lower the deflections which the cylinder head would otherwise experience. The lower deflections result in lower total stresses in the cylinder head and cylinder head casting and this improves the durability of the cylinder head casting.

Cylinder heads of internal combustion engines commonly experience high stresses due to cylinder pressure and assembly loading. These loads often lead to high cycle fatigue cracks in the cylinder head casting. This in turn causes the cylinder head casting to be replaced with a new part, an event which results in a significant cost being incurred by the customer or by the manufacturer if the cylinder head is still under warranty, which is often the case.

There are a number of internal cavities which are created in a cylinder head which are essential to its intended functioning during the operation of the engine. These internal cavities include an upper water jacket, a lower water jacket, intake ports, and exhaust ports. These internal cavities are often highly stressed due to a combination of assembly loads and cylinder pressure loads. This combination of loads and the overall loading experienced by the cylinder head typically results in high tensile stresses in one or more of the fillets within the upper water jacket. While the lower water jacket fillets may also experience higher tensile stresses at load versus no load, the size of the corresponding water passageway does not create the same level of concern as that of the upper water jacket, nor does the specific location of the lower water jacket create the same level of concern.

The presence of higher tensile stresses in the fillets of the upper water jacket causes these fillets to become points of weakness and, with continued operation of the engine, these fillets will in time experience high cycle fatigue cracks. Once the high cycle fatigue cracks appear, the situation only becomes worse and ultimately the cylinder head casting must be replaced. While high cyclic loading and high tensile stresses, regardless of the cause, can in time lead to some mode of failure or at least performance deterioration, the issue is how quickly this occurs and the magnitude of the failure. In the case of a cylinder head, hundreds of thousands of miles are expected without any mode of failure that significantly detracts from engine performance. Obviously any substantial reduction in this expected duty cycle is unacceptable.

Even if a suitable minimum duty cycle, meeting the expectations of the manufacturer and purchasers, could be provided, an extended duty cycle for a cylinder head and cylinder head casting would still present an improvement in cylinder head design. With an extended duty cycle, the purchaser receives a better, more reliable cylinder head. The present invention is directed to this end result by incorporating gusset-like ribs in the upper water jacket to actually eliminate one or more of the fillets that are likely to experience (prematurely) high cycle fatigue cracks. By removing one or more of these fillets, there is less likelihood of a crack initiating, resulting in a more durable cylinder head casting and, in turn, an improved cylinder head.

SUMMARY OF THE INVENTION

A cylinder head casting for an engine according to one embodiment of the present invention comprises a first casting portion defining a valve guide bore, a second casting portion defining a head bolt bore, and a first gusset rib extending between the first casting portion and the second casting portion.

One object of the present invention is to provide an improved cylinder head casting.

Related objects and advantages of the present invention will be apparent from the following description.

DESCRIPTION OF THE PREFERRED EMBODIMENTS

Figure 1:
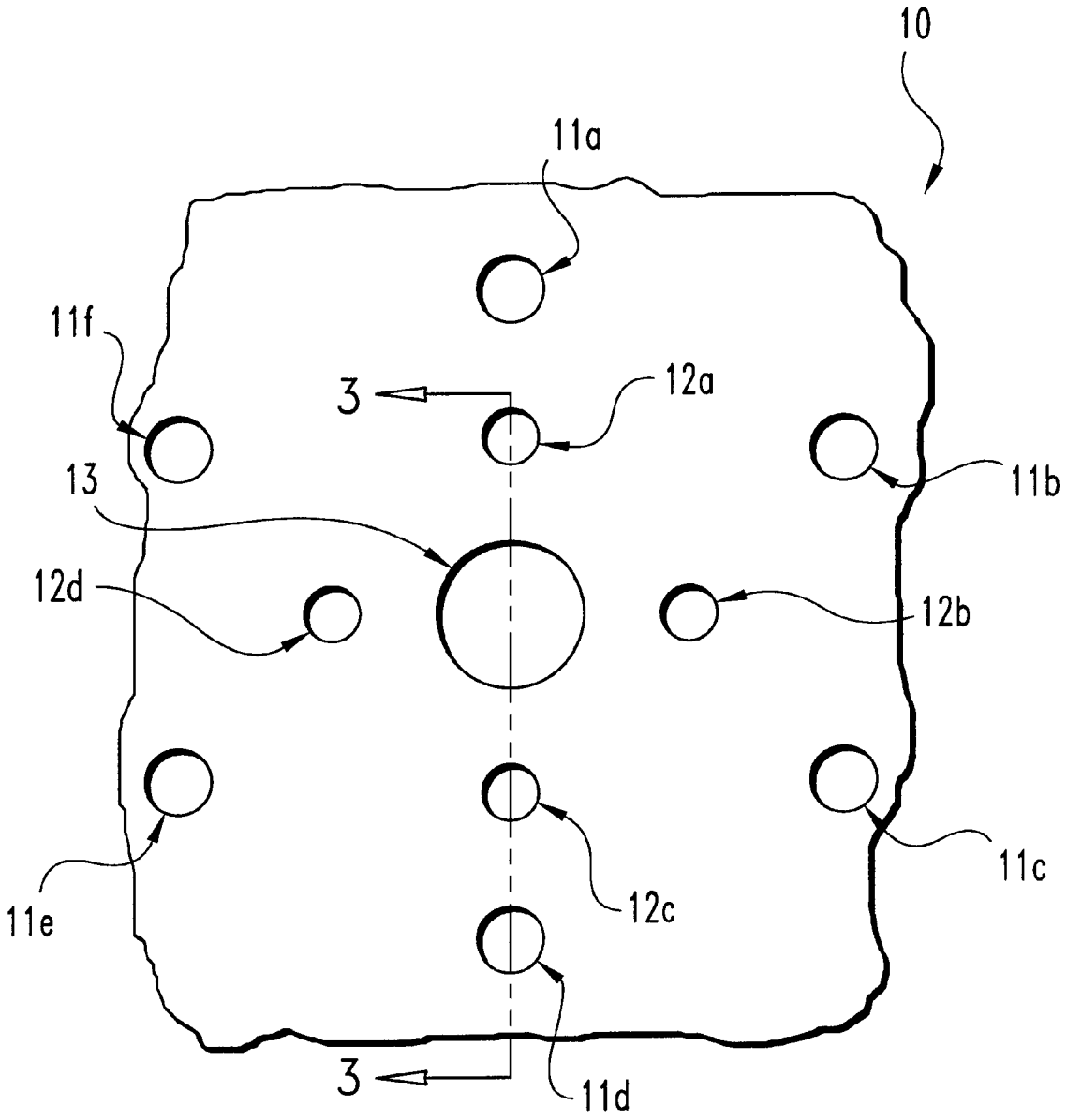
Fig. 1 (PRIOR ART)
FIG. 1 is a partial, top plan view of a prior art cylinder head casting.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
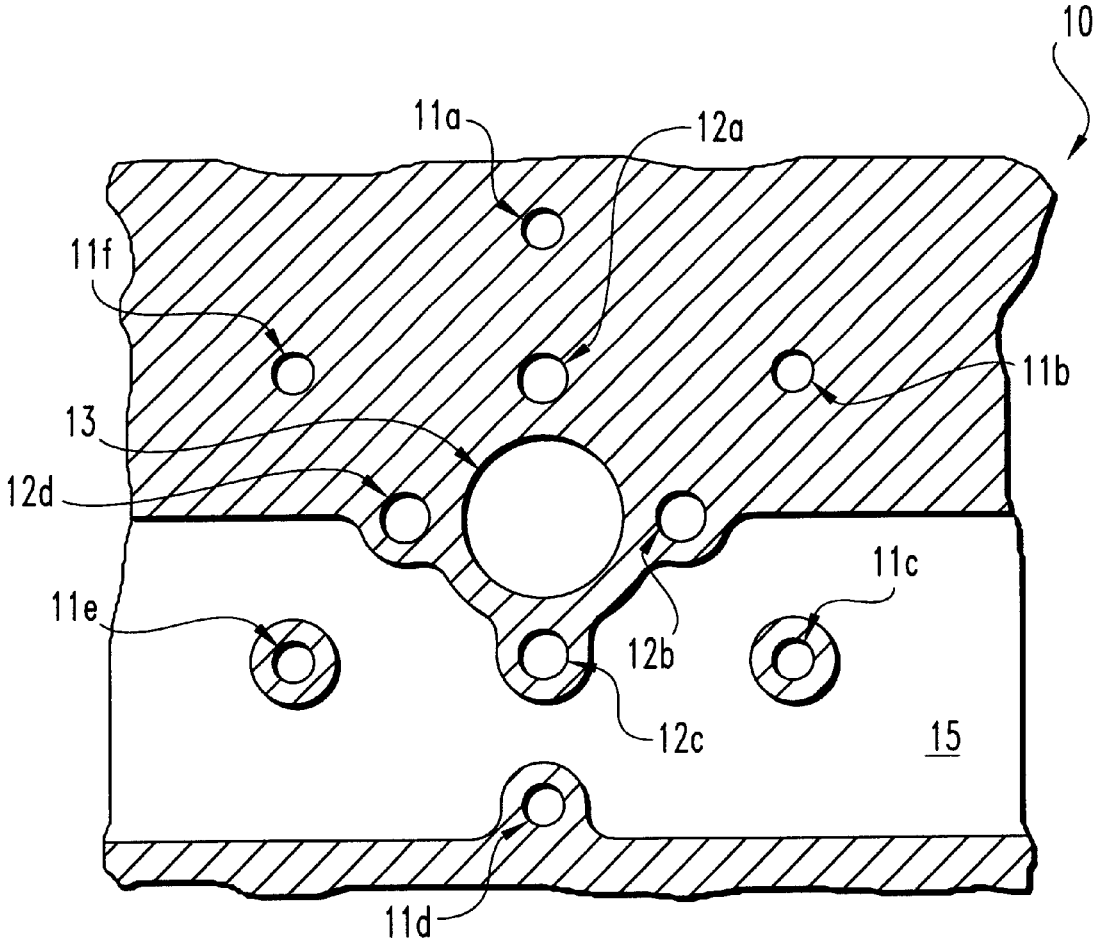
Fig. 2 (PRIOR ART)
FIG. 2 is a partial, top plan view, in full section, of the FIG. 1 cylinder head casting.
Figure 3:
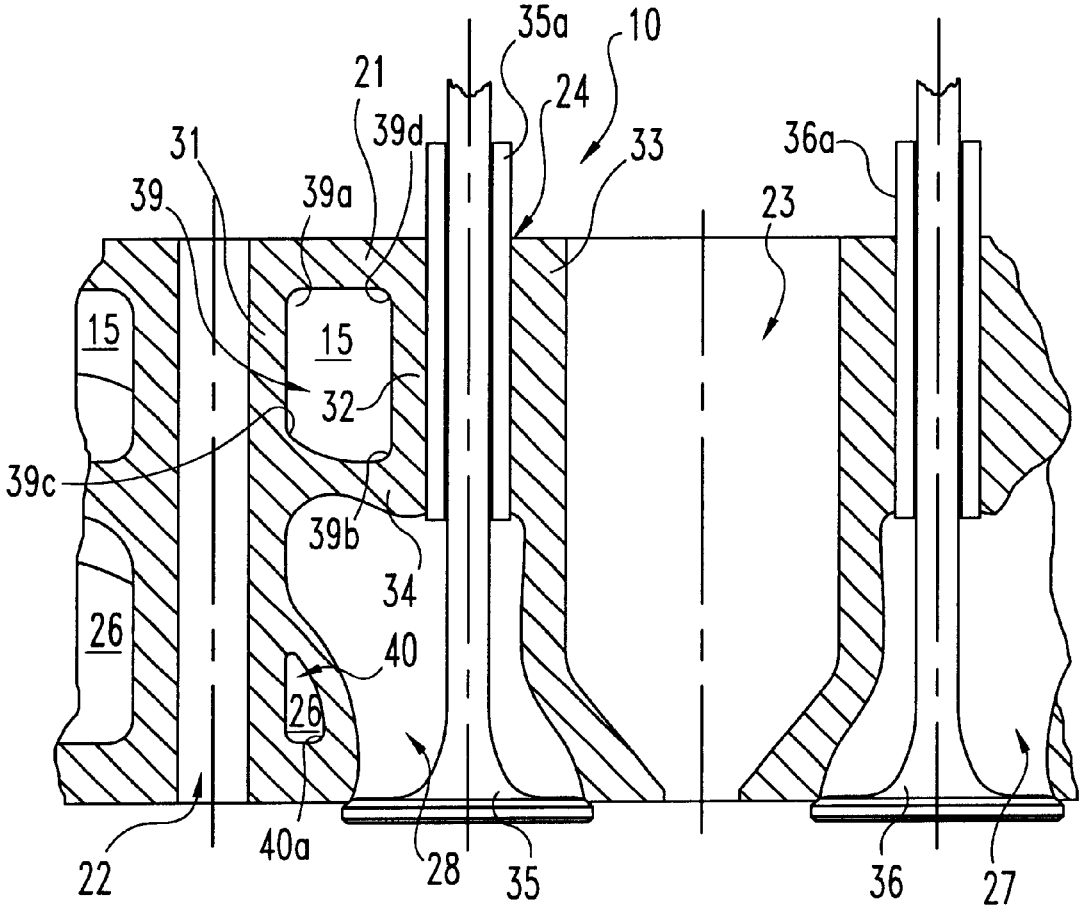
Fig. 3 (PRIOR ART)
FIG. 3 is a partial, front elevational view, in full section, of the FIG. 1 cylinder head casting as viewed along line 3—3 in FIG. 1.

Referring to FIGS. 1, 2, and 3, there is illustrated a portion of a typical, prior art cylinder head 10. Since all bolts, valves and injectors have been omitted for drawing clarity, cylinder head 10 in effect represents the cylinder head casting. The top plan view of FIG. 1 includes the bolt bore locations 11*a*–11*f*, the valve and valve guide locations 12*a*–12*d*, and one injector bore location 13. FIG. 2 is a full section, top plan view corresponding to FIG. 1 showing additional internal features including the upper water jacket 15. FIG. 3 is a side elevational view in full section, as viewed along line 3—3 in FIG. 1. Two valves and their cooperating valve guides have been added back into FIG. 3 to help with the orientation of the figure and the structure which is illustrated. Included as part of the illustrated portion of the unitary cylinder head casting 21 in FIG. 3 is a bolt bore 22 corresponding to bolt bore location 11*d*, injector bore 23 corresponding to location 13, and valve guide bore 24 corresponding to valve and valve guide location 12*c*. Also illustrated in FIG. 3 are upper water jacket 15, lower water jacket 26, intake port 27, and exhaust port 28.

The bolt bore 22 is defined by bolt boss sidewall 31 which also defines part of the upper water jacket 15 and part of the lower water jacket 26. The valve guide bore 24 is defined in part by sidewall 32 which also defines part of the upper water jacket 15. Sidewall 33 cooperates to define part of the valve guide bore 24 and part of the injector bore 23. The exhaust port 28 is defined in part by sidewall 33, in part by sidewall 31, and in part by dividing wall 34. The illustrated portion of the cylinder head 10 includes, in addition to the cylinder head casting 21, valves 35 and 36 and cooperating valve guides 35*a* and 36*a*, respectively. As would be understood from the foregoing description, the sidewalls 31, 32, and 33 and the dividing wall 34 are all portions of the unitary cylinder head casting 21. These various portions of the cylinder head casting define the various valve guide bores, head bolt bores, and injector bores as would be understood in the context of a unitary casting.

The portion 39 of the upper water jacket 15 which is located between the bolt bore 22 and valve guide bore 24 includes fillets 39*a*, 39*b*, 39*c*, and 39*d*. Due to the high stresses resulting from the cylinder pressures and assembly loading, fillets 39*a* and 39*b* are likely to experience premature high cycle fatigue cracking. This in turn results in premature failure of the cylinder head casting and a need to replace the cylinder head casting. The portion 40 of the lower water jacket 26 which is located between the bolt bore 22 and exhaust port 28 also includes a fillet 40*a*. However, due to the respective size differences between portions 39 and 40 and the corresponding differences in the cyclic loading and tensile stresses, the focus of the present invention is directed to the upper water jacket 15. In particular, the present invention is directed to reducing the tendency of fillets 39*a* and 39*b* to experience sufficient stresses for high cycle fatigue cracks to appear.

Figure 4:
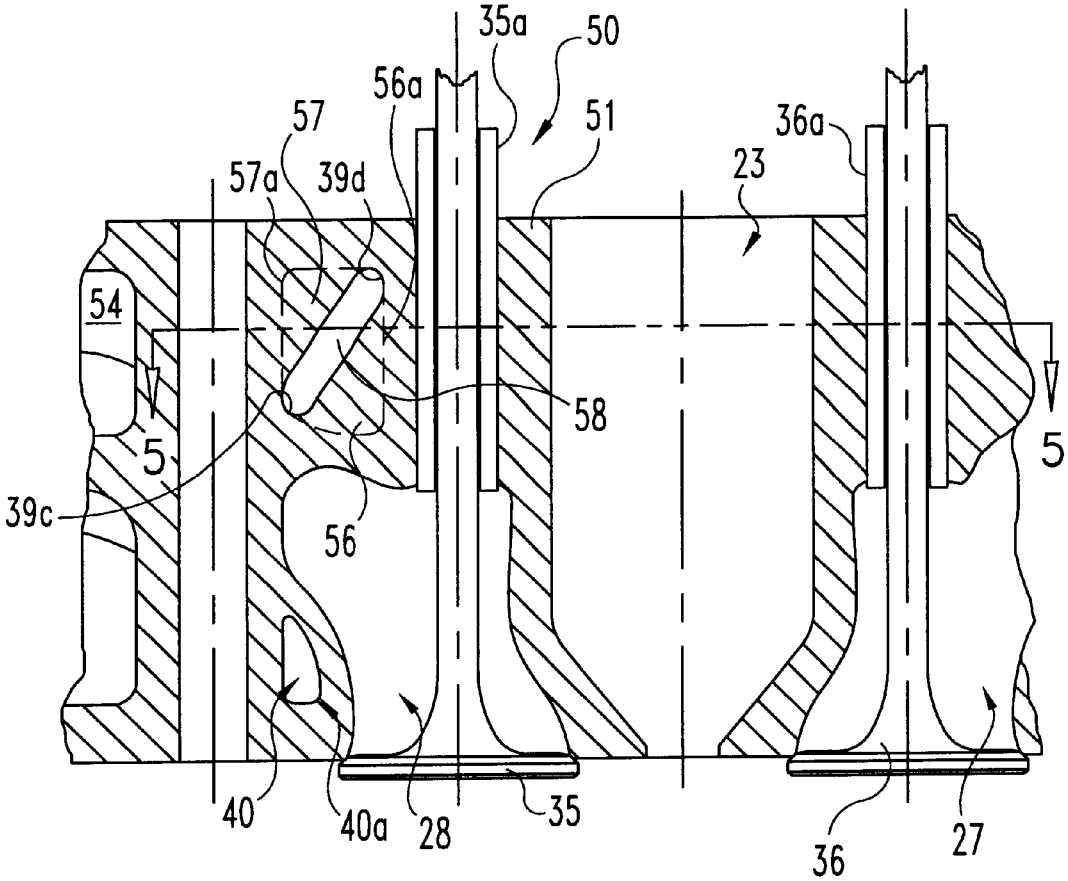
FIG. 4 is a partial, front elevational view in full section corresponding to FIG. 3 and incorporating gusset ribs in the upper water jacket according to a typical embodiment of the present invention.
Figure 5:
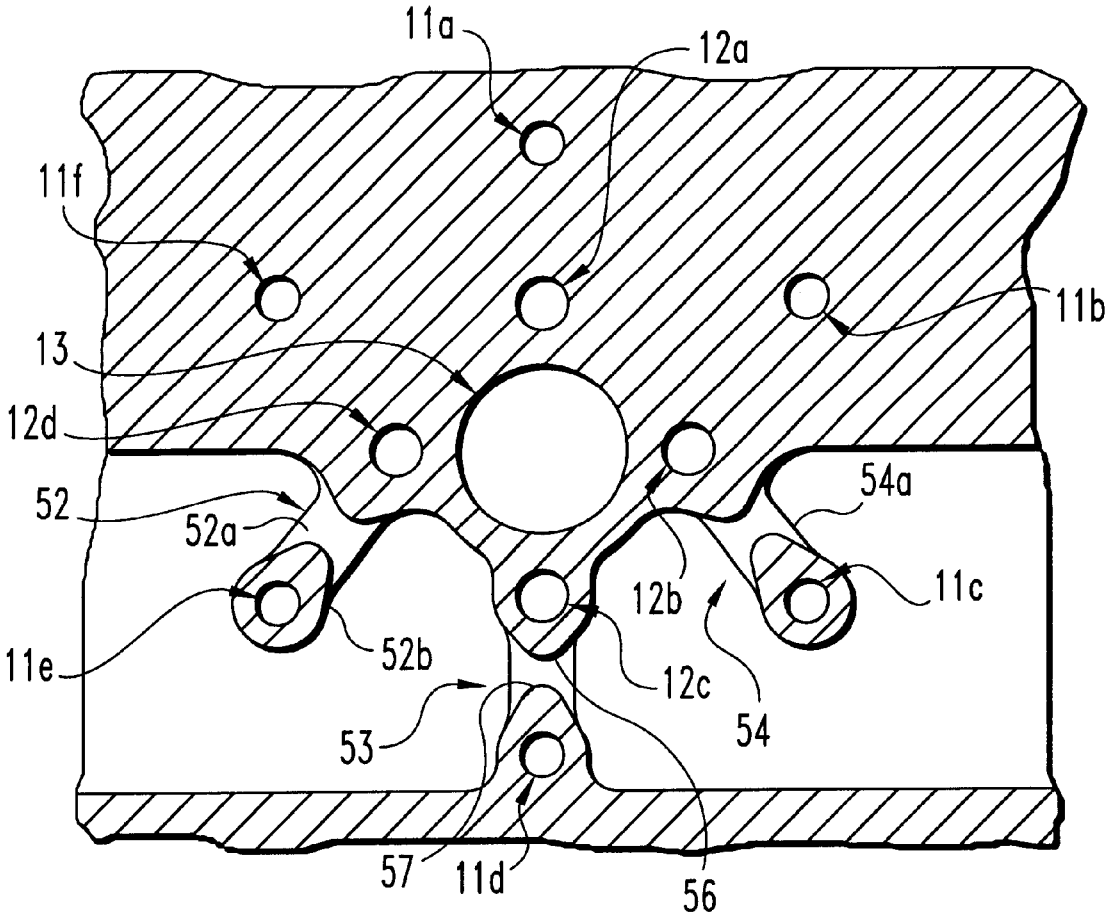
FIG. 5 is a partial, top plan view, in full section, of the FIG. 4 cylinder head casting as viewed along line 5—5 in FIG. 4 according to the present invention.

Referring to FIGS. 4 and 5, the cylinder head structure according to the present invention is illustrated. At the outset it should be noted that the portion of the cylinder head 50 which is illustrated in FIGS. 4 and 5 and in particular the cylinder head casting 51 are identical to the stricture of cylinder head 10 and cylinder head casting 21, respectively, except for the elimination of fillets 39*a* and 39*b* and the addition of gusset ribs in those locations.

There are three gusset rib locations 52, 53, and 54 illustrated in FIG. 5. Gusset rib 52*a* at location 52 extends between the casting portions defining the bolt bore at location 11*e* and the valve guide bore at location 12*d*. Gusset ribs 56 and 57 at location 53 extends between the casting portions defining the bolt bore at location 11*d* and the valve guide bore at location 12*c*. Gusset rib 54*a* at location 54 extends between the casting portions defining the bolt bore at location 11*c* and the valve guide bore at location 12*b*. The internal configuration of gusset rib location 53 is illustrated in FIG. 4. The length of each gusset rib is controlled by the bolt bore locations relative to the corresponding (connected) valve guide locations and the thickness of the defining casting portions unitarily connected (cast) to the intermediate and corresponding gusset ribs. The thickness of each gusset rib is equal to or less than the diameter or width of the casting portion defining the corresponding head bolt bore. Preferably the minimum gusset rib thickness is 5 mm, determined by casting process considerations. As a result, it is possible to include connection fillets as part of each gusset rib such as fillet 52*b*, for example, in order to avoid introducing additional stress risers. Preferably the gusset rib fillets have a minimum radius of at least 5 mm.

At location 53, gusset ribs 56 and 57 are unitarily cast as part of the cylinder head casting 51 and are located in the upper water jacket 54 which is otherwise identical to upper water jacket 15. By comparing the illustrations of FIGS. 4 and 5, and the cutting plane 5—5 in FIG. 4, it will be seen that gusset rib location 53 includes both gussets ribs 56 and 57.

The broken lines 56*a* and 57*a* of FIG. 4 are included to diagrammatically illustrate how the portion 39 has been filled in by the addition of material to casting 51 in the form of gusset ribs 56 and 57. Gusset ribs 56 and 57 are spaced apart as illustrated in FIG. 4 with a clearance portion or passageway 58 defined therebetween. The shape of the passageway 58 which results from the addition of gusset ribs 56 and 57 shows that the fillets 39*a* and 39*b* have been eliminated in those areas where the gusset ribs 56 and 57 are added. While the elimination of these fillets 39*a* and 39*b* eliminates the possibility of high cycle fatigue cracking at those locations, the gusset ribs 56 and 57 actually provide important stiffening of the cylinder head casting 51 throughout the portion of the upper water jacket 54 between the bolt bore 22 and valve guide bore 24. Consequently, there is less deflection and less tensile stress in this area of the cylinder head casting.

The addition of gussets ribs 56 and 57 at location 53 and the addition of similar gusset ribs at locations 52 and 54 is representative of the present invention. As explained, the stiffening which is provided to the cylinder head casting and more specifically to the area of the upper water jacket results in significantly lower deflections due to cylinder pressure. This in turn results in lower total stresses in the cylinder head when exposed to the cylinder pressure loading. This improves the durability of the cylinder head casting.

While only one injector bore location 13 is illustrated (see FIGS. 2 and 5), the gusset rib pattern of FIG. 5 would preferably be repeated for other similar locations within the cylinder head casting 21 (51) according to the present invention. The key is to add one and preferably both gusset ribs, like gusset ribs 56 and 57, at each valve guide bore location in the upper water jacket. The addition of gusset ribs according to the present invention, such as gusset ribs 56 and 57, essentially removes one or more of the tensile fillets, such as fillets 39*a* and 39*b*, from the cylinder head casting 51, and according there is less likelihood of a fatigue crack initiating.

The addition of the gusset ribs still permits the venting of trapped air and allows drainage of coolant during maintenance of the engine. Due to the geometry and locations of the gusset ribs according to the present invention, such as gusset ribs 56 and 57, minimal air pockets and potentially none are formed at the top of the upper water jacket 54. This allows for good system venting and avoids pockets of hot steam being trapped within the cylinder head. In order to provide a brief background discussion with regard to the venting of trapped air, it is to be noted that typically a check valve is provided as part of the engine cooling system and is plumbed at the highest location in the engine cooling system. The addition of coolant forces the trapped air up and out through this valve. If it would be possible for pockets of air to become trapped in the cylinder head (or in any other engine component or region), this would reduce the amount of coolant that could initially be installed. Under these circumstances, once the engine goes into operation, fluid dynamics help "purge" these trapped pockets of air, thereby venting the system. The reservoir in the cooling system then feeds more coolant into the system in order to displace these air pockets. While this approach may function acceptably, it requires the maintenance workers to come back and "top off" the coolant reservoir after the engine has been run. Accordingly, any design modifications to the cylinder head should be made in such a manner that will not create trapped pockets of air. Every location in the closed cooling system of a typical diesel engine should be able to establish a path to the vent line without ever having to reduce the "altitude" of the roof. The addition of gusset rib 57, as illustrated in FIG. 4, does not alter the "altitude" of the roof of the upper water jacket 54 in the area of fillet 39*d*. Consequently, there is no effective loss of venting capability within the cylinder head as a result of adding gusset rib 57. Likewise, the addition of gusset ribs 56 and 57 do not create any greater tendency for any trapped pockets of air within the cylinder head.

Due to the geometry and locations of the gusset ribs, all (or almost all) of the coolant drains out when servicing the engine, thereby avoiding residual puddles where debris can collect and become trapped. With regard to the prior description concerning venting considerations and in a manner somewhat analogous to that, every location within the cooling system of the engine should be able to take a path to the drain plug without ever having to increase "altitude". The addition of gusset rib 56 does not significantly alter that "altitude" of the floor of the upper water jacket 54 in the area of fillet 39*c* (see FIG. 4). Consequently, there is no significant loss of drainage capability by the addition of gusset rib 56. Occasionally, though not always, the coolant flow in the upper water jacket is designed to flow along the length of the head, from one end to the other, so that one common outlet can be used. This type of coolant flow configuration would necessitate that the space between sidewalls 31 and 32 remain open, as illustrated in FIG. 2, between valve guide location 12*c* and bolt bore location 11*d*. This opening is maintained even after the addition of gusset ribs 56 and 57, as now illustrated in FIG. 4 and as illustrated in FIG. 5 at location 53.

The gusset ribs do not negatively influence or affect thermally driven stresses. As such, there are no apparently downsides or negatives associated with the addition of the described gusset ribs. On the positive side, these gusset ribs provide an improved load path from the bolt bosses into the inner injector bore and the valve guide boss structures. This results in reducing overall cylinder head deflections and strains and an improvement in cylinder head fatigue life.

It is to be noted that the preferred or optimum geometry of the gussets ribs is driven to some degree by the cylinder head design. However, generally the gusset ribs according to the present invention are positioned between the boss or sidewall defining the valve guide bore 24 and the boss defining a head bolt bore 22. Both gusset ribs have openings to allow the flow of coolant across the top of the exhaust port.

While two gusset ribs are preferable in the modification of portion 39 so as to eliminate both fillets 39*a* and 39*b*, practical manufacturing considerations, such as core strength and sand clean out, might result in the use of only one gusset rib at this location, and at similar locations, instead of two gusset ribs as illustrated and described.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A unitary cylinder head casting for an engine comprising:

a first casting portion defining a valve guide bore;

a second casting portion defining a head bolt bore; and a first gusset rib extending between said first casting portion and said second casting portion.

2. The cylinder head casting of claim 1 wherein said first casting portion is adjacent an injector bore.

3. The cylinder head casting of claim 2 which further defines a water jacket and wherein said first gusset rib is positioned in said water jacket.

4. The cylinder head casting of claim 1 which further defines a water jacket and wherein said first gusset rib is positioned in said water jacket.

5. A unitary cylinder head casting for an engine comprising:

a plurality of valve guide bore casting portions, each valve guide bore casting portion defining a valve guide bore;

a plurality of head bolt bore casting portions, each head bolt bore casting portion defining a head bolt bore, there being at least one head bolt bore corresponding to each valve guide bore; and a plurality of first gusset ribs, there being one first gusset rib extending between each combination of one head bolt bore casting portion and its corresponding valve guide bore casting portion.

6. The cylinder head casting of claim 5 which further defines a water jacket and wherein each first gusset rib of said plurality of first gusset ribs is positioned in said water jacket.

7. The cylinder head casting of claim 5 which further defines a water jacket and wherein each first gusset rib of said plurality of first gusset ribs is positioned in said water jacket.

8. A cylinder head casting for an engine comprising:

a first casting portion defining a valve guide bore;

a second casting portion defining a head bolt bore;

a first gusset rib extending between said first casting portion and said second casting portion;

wherein said cylinder head casting is a unitary structure adjacent an injector bore;

wherein said cylinder head further defines a water jacket;

wherein said first gusset rib is positioned in said water jacket; and a second gusset rib extending between said first casting portion and said second casting portion.

9. The cylinder head casting of claim 8 wherein said first gusset rib and said second gusset rib are spaced apart and define a passageway therebetween.

10. A cylinder head casting for an engine comprising:

a first casting portion defining a valve guide bore;

a second casting portion defining a head bolt bore;

a first gusset rib extending between said first casting portion and said second casting portion; and a second gusset rib extending between said first casting portion and said second casting portion.

11. The cylinder head casting of claim 10 wherein said first gusset rib and said second gusset rib are spaced apart and define a passageway therebetween.

12. A cylinder head casting for an engine comprising:

a plurality of valve guide bore casting portions, each valve guide bore casting portion defining a valve guide bore;

a plurality of head bolt bore casting portions, each head bolt bore casting portion defining a head bolt bore, there being at least one head bolt bore corresponding to each valve guide bore;

a plurality of first gusset ribs, there being one first gusset rib extending between each combination of one head bolt bore casting portion and its corresponding valve guide bore casting portion;

wherein said cylinder head casting is a unitary structure;

wherein said cylinder head casting further defines a water jacket and wherein each first gusset rib of said plurality of first gusset ribs is positioned in said water jacket; and a plurality of second gusset ribs, there being one second gusset rib extending between each combination of one head bolt bore casting portion and its corresponding valve guide bore casting portion.

13. The cylinder head casting of claim 12, wherein each second gusset rib is spaced apart from a corresponding one of said first gusset ribs, said corresponding first and second gusset ribs defining a passageway therebetween.

14. A cylinder head casting for an engine comprising:

a plurality of valve guide bore casting portions, each valve guide bore casting portion defining a valve guide bore;

a plurality of head bolt bore casting portions, each head bolt bore casting portion defining a head bolt bore, there being at least one head bolt bore corresponding to each valve guide bore;

a plurality of first gusset ribs, there being one first gusset rib extending between each combination of one head bolt bore casting portion and its corresponding valve guide bore casting portion; and a plurality of second gusset ribs, there being one second gusset rib extending between each combination of one head bolt bore casting portion and its corresponding valve guide bore casting portion.

15. The cylinder head casting of claim 14 wherein each second gusset rib is spaced apart from a corresponding one of said first gusset ribs, said corresponding first and second gusset ribs defining a passageway therebetween.

16. A cylinder head casting for an engine defining a water jacket and comprising:

a first casting portion defining a valve guide bore;

a second casting portion defining a head bolt bore; and a water jacket portion extending between said first casting portion and said second casting portion and including a plurality of fillets, one of said fillets being filled in by the addition of a gusset rib which is in unitary construction with one of said first and second casting portions.

* * * * *

UNITED STATES PATENT AND TRADEMARK OFFICE

CERTIFICATE OF CORRECTION

PATENT NO. : 6,330,872 B1
DATED : December 18, 2001
INVENTOR(S) : Leonard et al.

It is certified that error appears in the above-identified patent and that said Letters Patent is hereby corrected as shown below:

Column 3,
Line 31, replace “stricture” with -- structure --.

Signed and Sealed this

Fourth Day of June, 2002

*Attest:*

*Attesting Officer*

JAMES E. ROGAN
*Director of the United States Patent and Trademark Office*